US006439968B1

(12) United States Patent
Obeng

(10) Patent No.: US 6,439,968 B1
(45) Date of Patent: Aug. 27, 2002

(54) POLISHING PAD HAVING A WATER-REPELLANT FILM THERON AND A METHOD OF MANUFACTURE THEREFOR

(75) Inventor: Yaw S. Obeng, Orlando, FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/514,832

(22) Filed: Feb. 28, 2000

Related U.S. Application Data

(60) Provisional application No. 60/141,657, filed on Jun. 30, 1999.

(51) Int. Cl.[7] ..... B24B 7/22; B24D 17/00

(52) U.S. Cl. ..... 451/41; 451/526

(58) Field of Search ..... 451/41, 287, 288, 451/526; 156/345; 216/89; 438/692, 693

(56) References Cited

U.S. PATENT DOCUMENTS 4,954,141 A 9/1990 Takiyama et al.
5,064,683 A * 11/1991 Poon et al. ..... 427/39
5,310,455 A * 5/1994 Pasch et al. ..... 156/636
5,314,843 A * 5/1994 Yu et al. ..... 437/225
5,403,228 A * 4/1995 Pasch ..... 451/259
5,609,719 A * 3/1997 Hempel ..... 156/636.1
5,785,584 A 7/1998 Marmillion et al.
5,855,804 A * 1/1999 Walker ..... 156/345
5,897,424 A 4/1999 Evans et al.

FOREIGN PATENT DOCUMENTS

EP 0 607 441 A1 7/1994

* cited by examiner

*Primary Examiner*—Robert A. Rose

(57) ABSTRACT

The present invention provides a polishing pad. The polishing pad includes a base pad, such as a felt pad, having an outer surface, and a water-repellant film located on the outer surface. The water-repellant film typically provides the base pad with a water absorbency factor of less than about five percent. In another embodiment, the polishing pad has an outer surface having an outer edge and first and second opposing surfaces joined by the outer edge. The polishing pad, in a preferred embodiment, has the water-repellant film located on the outer edge and one of the first and second opposing surfaces. Located on the water-repellant film on one of the first and second opposing surfaces, in another embodiment, is a pressure sensitive adhesive.

13 Claims, 5 Drawing Sheets

POLISHING PAD HAVING A WATER-REPELLANT FILM THERON AND A METHOD OF MANUFACTURE THEREFOR

CROSS-REFERENCE TO PROVISIONAL APPLICATION

This application claims the benefit of U.S. Provisional Application No. 60/141,657 entitled "SOLVENT ABSORPTION BY CMP PADS AND ITS RELATIONSHIP TO PAD CHEMISTRY," to Obeng, et al., filed on Jun. 30, 1999, which is commonly assigned with the present invention and incorporated herein by reference as if reproduced herein in its entirety.

TECHNICAL FIELD OF THE INVENTION

The present invention is directed, in general, to a polishing pad and, more specifically, to a polishing pad having a water-repellant film thereon, and a method of manufacture therefor.

BACKGROUND OF THE INVENTION

Semiconductor devices over the last few years have dramatically reduced in size. Current semiconductor technology is focusing on sub 0.35 $\mu$m devices, and more specifically, sub 0.25 $\mu$m devices. To accommodate such decreasing sizes, the semiconductor manufacturing industry has had to focus on current processing techniques. One of such processing techniques that has had extreme focus thereon, is chemical mechanical polishing (CMP). CMP and its derivatives appear to be the only techniques currently available, with the ability to meet the planarity requirements of sub 0.35 $\mu$m circuit technology.

The CMP process involves holding, and optionally rotating, a thin, reasonably flat, semiconductor wafer against a rotating polishing platen. Likewise, the wafer may be repositioned radially within a set range on the polishing platen, as the platen is rotated. A conventional polishing pad 100 is affixed to the polishing platen and wetted by a chemical slurry, under controlled chemical, pressure, and temperature conditions (FIG. 1). As illustrated in FIG. 1, a conventional polishing pad consists of a felt pad 120 with a polyurethane pad 140 located thereover, and connected thereto with an epoxy material 130. Located below the felt pad 120 is a pressure sensitive adhesive (PSA) 110, which connects the polishing pad 100 to the above mentioned polishing platen.

To minimize set-up time and consumable costs, the CMP assembly must be kept wet, thus having slurry deposited on it at all times. This tends to cause the slurry to run down the side of the polishing platen and come in contact with the edge of the polishing pad 100. Unfortunately, current pads, and more specifically the felt pads 120, have a tendency to absorb water/fluids when in contact with the slurry. This occurs because the edge of felt pad wickens, thus, causing the entire felt pad 120 to become water/fluid logged. When the felt pad 120 stays water/fluid logged, its performance with time is negatively impacted. Furthermore, polishing pads and other materials based of polyurethane are susceptible to attacks by acids and bases. It has been found that upon exposure to a chemical environment, the solvent wets, penetrates and swells the polyurethane matrix of the polishing pads, also impacting their performance with time.

Accordingly, what is needed in the art is a polishing pad for use in current CMP technology, that does not experience the absorption problems associated with the prior art polishing pads.

SUMMARY OF THE INVENTION

To address the above-discussed deficiencies of the prior art, the present invention provides a polishing pad. In a preferred embodiment, the polishing pad includes a base pad, such as a felt pad, having an outer surface. The polishing pad also, in the same embodiment, has a water-repellant film located on the outer surface of the base pad, which, in a preferred embodiment, provides the base pad with a water absorbency factor of less than about five percent. In another embodiment, the polishing pad has an outer surface that has an outer edge, and first and second opposing surfaces joined by the outer edge. The polishing pad, in another embodiment, has the water-repellant film located on the outer edge, and one of the first and second opposing surfaces. Located on the water-repellant film on one of the first and second opposing surfaces, in another embodiment, is a pressure sensitive adhesive.

Thus, in one aspect, the present invention provides a base pad having a water-repellant film located thereon. This unique base pad inhibits fluids, acids and bases from entering the base pad and having a negative impact on their performance.

In another aspect of the invention, the water-repellant film is located on the outer edge, and the first and second opposing surfaces. In another aspect, the water-repellant film includes polyurethane and a fluorinated polymer, wherein the fluorinated polymer may be polytetrafluoroethylene. The water-repellant film should, in another aspect, be resistive to chemical reaction with acids or bases.

In another embodiment, the polishing pad has a main pad located over one of the first and second opposing surfaces, and coupled to the base pad. In such an embodiment, the water repellant film may be located over an outer edge of the main pad. In another embodiment, the water-repellant film includes a water resistant polymer, such as polystyrene, polypropylene, or polyvinyl chloride.

Another aspect of the present invention provides a polishing apparatus. The polishing apparatus, in a preferred embodiment, includes a platen, a polishing head and the polishing pad discussed previously. Furthermore, another aspect of the invention provides a method of fabricating the polishing pad. The method includes providing a base pad having an outer edge and forming a water-repellant film on the outer edge.

In another aspect, provided is a method of manufacturing a semiconductor device. The method, in a preferred embodiment, includes: (1) forming transistors on a semiconductor wafer, (2) forming a substrate over the transistors, (3) positioning the semiconductor wafer on the polishing pad described above, (4) polishing the substrate of the semiconductor wafer with the pad, and (5) interconnecting the transistors to form an integrated circuit.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
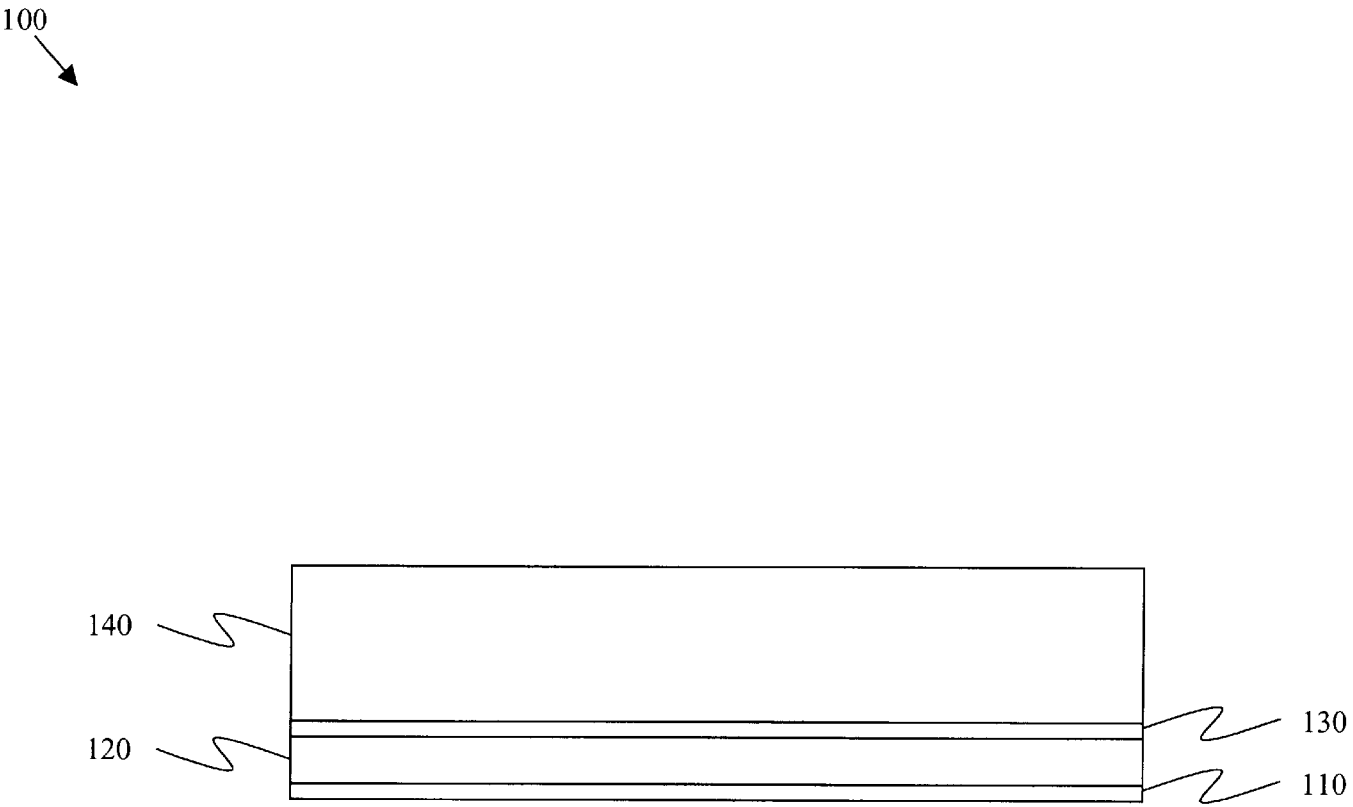
FIGURE 1 PRIOR ART
FIG. 1 illustrates a conventional polishing pad.
Figure 2:
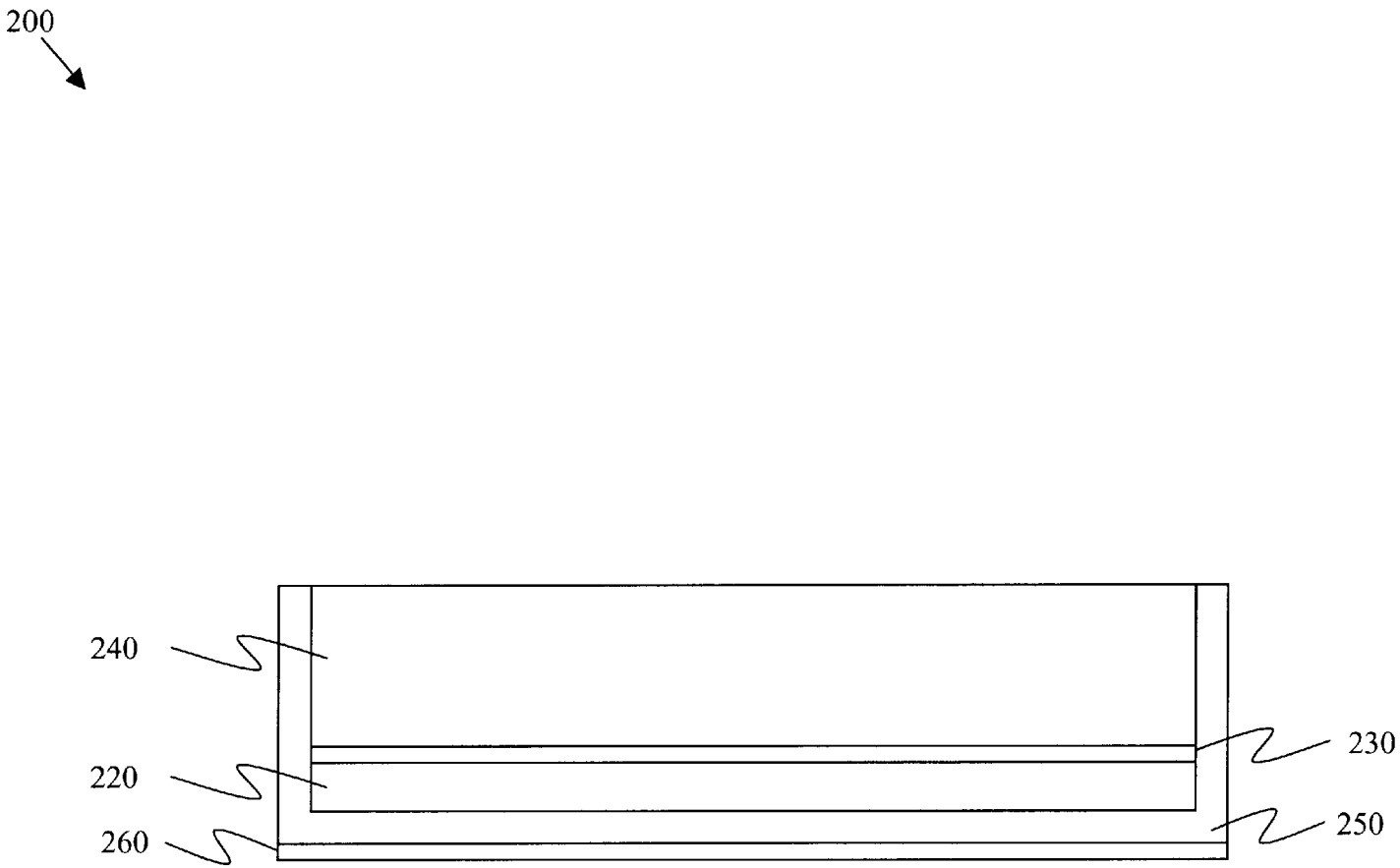
FIG. 2 illustrates a completed polishing pad covered by one embodiment of the present invention, including a water-repellant film containing polystyrene.

Turning to FIG. 2, illustrated is a completed polishing pad 200 covered by one embodiment of the present invention. The completed polishing pad 200 includes a base pad 220 having an outer surface. The outer surface has an outer edge and first and second opposing surfaces joined by the outer edge. The base pad 220 commonly comprises felt; however, any other material having desirable properties may be used.

The completed polishing pad 200 also may include an adhesive material 230 located on one of the first and second opposing surfaces of the base pad 220. The adhesive material 230 may be any kind of epoxy material that provides adequate adhesion strength during chemical mechanical polishing (CMP). The adhesive material 230 couples the base pad 220 to a main pad 240. Typically, the main pad 240 comprises a polyurethane-based material; however, one skilled in the art knows that other similar materials could comprise the main pad 240. Furthermore, the main pad 240 is not required in all embodiments of the invention.

Located on the outer surface of the base pad 220 is a water-repellant film 250. As illustrated, the water-repellant film 250 is located on the outer edges of the main pad 240 and the base pad 220, and one of the first and second opposing surfaces of the base pad 220. The water repellant film 250 provides the base pad 220 with a water absorbency factor of less than about 5%. Thus, the water-repellant film 250, theoretically prevents slurry or any liquid associated therewith, from penetrating the base pad 220 and degrading its performance with time. The water-repellant film 250 may include a water-repellant polymer, and more specifically polystyrene, polypropylene or polyvinyl chloride. However, one skilled in the art knows that the water-repellant film 250 may comprise any other material having water-repellant properties consistent with the device design.

The water repellant film 250 is formed by placing the polishing pad 200, including the base pad 220, adhesive material 230 and the main pad 240, in an enclosed chamber. The top portion of the main pad 240 is protected and the polishing pad 200 is conventionally sprayed with the water-repellant polymer that has been dissolved in a solvent. The solvent may be a hydrocarbon solvent, such as pantene. After the polishing pad 200 has been appropriately coated with the water-repellant polymer, the polishing pad 200 is cured in steam. One having skill in the art knows that other similar processes could be used to form the water repellant film 250.

After the water repellant film 250 has been formed, a pressure sensitive adhesive (PSA) 260, as illustrated in FIG. 2, is formed. The PSA 260 is located on the water-repellant film 250, of which is located on one of the first and second opposing surfaces of the base pad 220. The PSA 260 provides an epoxy layer between the completed polishing pad 200 and a polishing platen (not shown).

Figure 3:
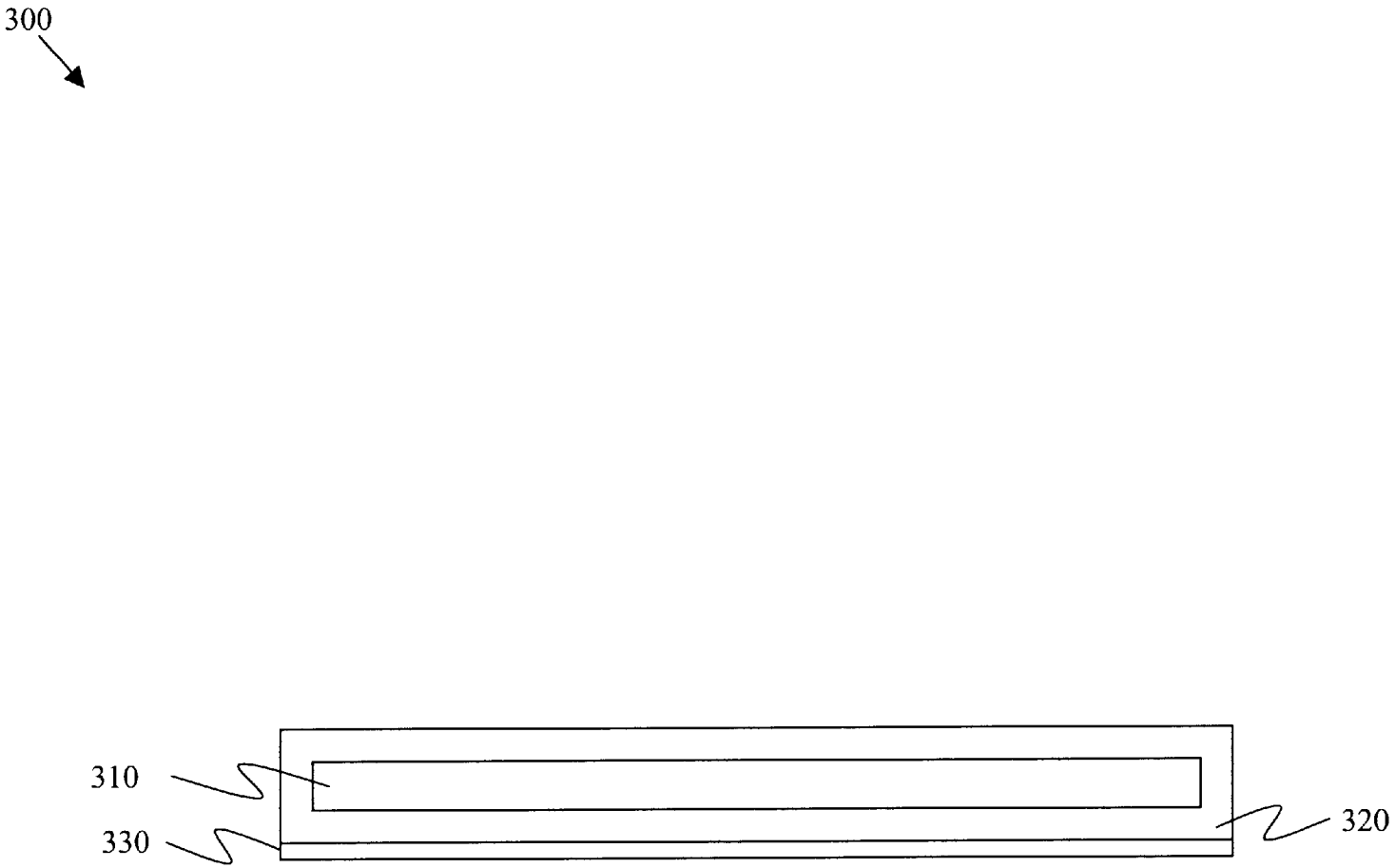
FIG. 3 illustrates a completed polishing pad covered by one embodiment of the present invention, including a water-repellant film containing polyurethane and a fluorinated polymer.

Illustrated in FIG. 3 is a completed polishing pad 300 taught by another embodiment of the invention. The polishing pad 300 includes a base pad 310 having an outer surface. The outer surface, as with the previous embodiment, includes an outer edge and first and second opposing surfaces joined by the outer edge. Like the base pad in the previous embodiment, the base pad 310 may comprise felt or any other material suitable for the polishing pad 300.

Located on the outer surface is a water-repellant film 320. More specifically, the water-repellant film 320 is located on the outer edge, and the first and second opposing surfaces joined by the outer edge, thus, encapsulating the base pad 310. The water-repellant film 320, in the illustrated embodiment, may include polyurethane and a fluorinated polymer. The fluorinated polymer, in an alternative embodiment, may be polytetrafluoroethylene. However, one skilled in the art knows that other materials being water, acid and base repellant may be combined with the polyurethane. In the illustrated embodiment, there is no main pad 240 (FIG. 2); however, one skilled in the art understands that the water-repellant film 320 may include polyurethane, which functions like the main pad 240 illustrated in FIG. 2.

The water-repellant film 320 is formed by taking the base pad 310 and coating it with a solution of polyurethane, a fluorinated polymer and a solvent. After the base pad 310, which is normally felt, has been thoroughly coated, the base pad 310 is rinsed with water. The water tends to drive the solvent out of the solution, leaving the polyurethane and fluorinated water-repellant film 320. One having skill in the art knows that the goal is to coat the base pad 310 with the water-repellant film 320, and that any process capable of adequately coating the base pad 310, may be used.

After the water-repellant film 320 has been formed, a PSA 330 is formed. The PSA 330 is located on one surface of the water-repellant film 320. As discussed earlier, the PSA 330 provides an epoxy layer between the completed polishing pad 300 and a polishing platen (not shown).

Figure 4:
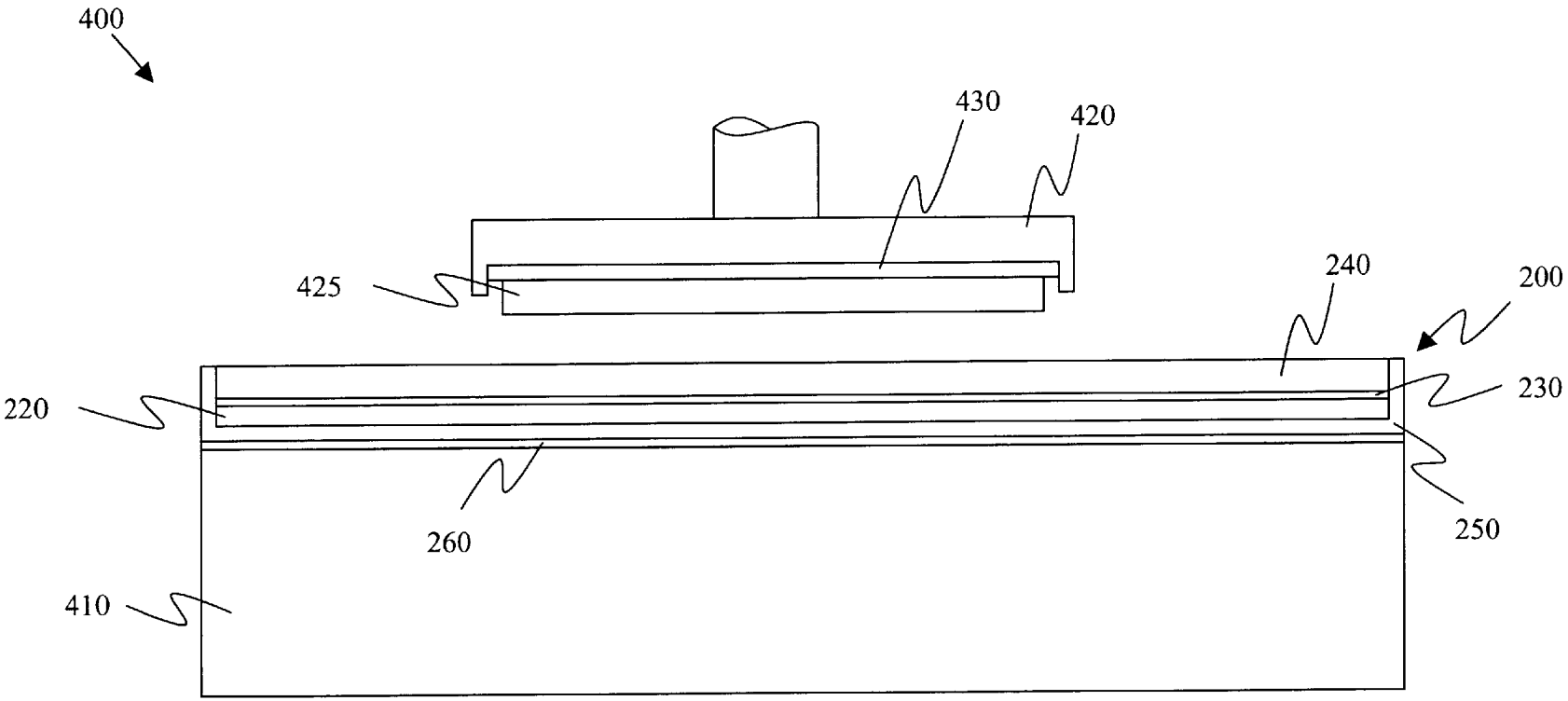
FIG. 4 illustrates a polishing apparatus, including the polishing pad depicted in FIG. 2.

Turning to FIG. 4, illustrated is the polishing pad 200 located within a polishing apparatus 400. The polishing apparatus 400 includes the polishing pad 200, located on a platen 410. As mentioned earlier, a PSA 260 may be located between the water-repellant film 250, that is located on one of the first and second opposing surfaces of the base pad 220, and the platen 410. One having skill in the art knows that, even though the polishing pad 200 depicted in FIG. 2 is illustrated on the polishing device 400, other polishing pads covered by the present invention, including the polishing pad 300 illustrated in FIG. 3, may be inserted therefor.

Over the polishing pad 200 is located a polishing head 420, containing the surface to be polished 425. Located between the polishing head 420 and the surface to be polished 425 is an adhesive and shock absorbing layer 430. One having skill in the art knows that the polishing platen 410 is rotating in a circular direction, either clockwise or counterclockwise, while a specific slurry material is deposited on the upper surface of the polishing pad 200. One having skill in the art also knows, that the composition of the slurry material depends on the surface being polished, pressure being applied and many other factors.

Figure 5:
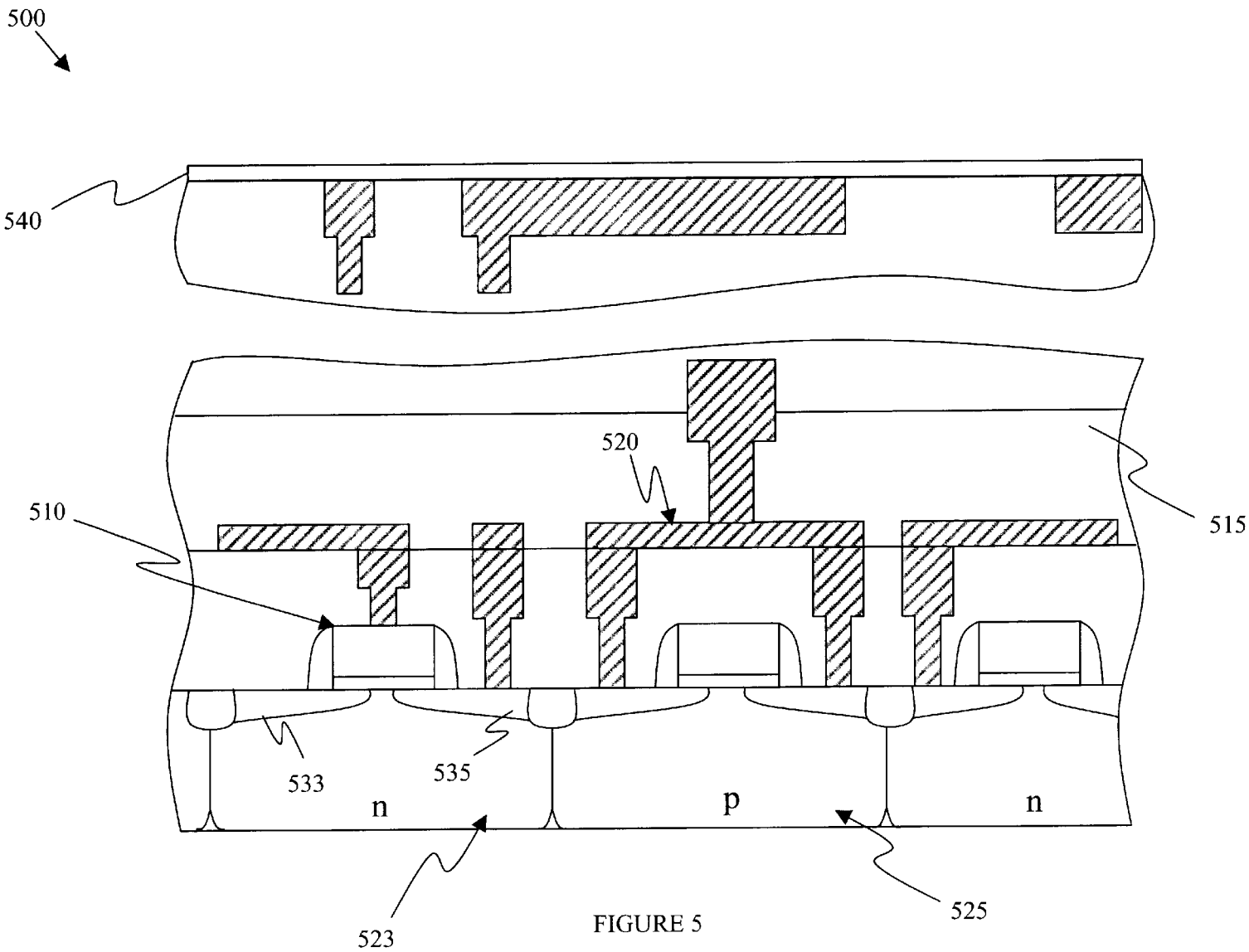
FIG. 5 illustrates a sectional view of a conventional semiconductor device that might be polished according to the principles of the present invention.

Turning briefly to FIG. 5, there is illustrated a sectional view of a conventional semiconductor device 500 that might be polished according to the principles of the present invention. The semiconductor device 500 may be a CMOS device, a BiCMOS device, a Bipolar device or any other type of integrated circuit. Also shown in FIG. 5 are components of the conventional semiconductor device 500, including: the transistors 510, dielectric layers 515 in which interconnect structures 520 are formed (together forming interconnect layers), the interconnect structures 520 connecting the transistors 510 to other areas of the semiconductor device 500, conventionally formed tubs, 523, 525, source regions 533 and drain regions 535. Also illustrated in FIG. 5 is a conventional capping layer 540.

Although the present invention has been described in detail, those skilled in the art should understand that they can make various changes, substitutions and alterations herein without departing from the spirit and scope of the invention in its broadest form.

What is claimed is:

1. A method of manufacturing a semiconductor device, comprising:

forming transistors on a semiconductor wafer;

forming a substrate over said transistors;

positioning said semiconductor wafer on a polishing pad, said polishing pad including:

a base pad having a first platen surface and a second opposing surface, wherein said first platen surface and said second opposing surface are joined by an outer edge; and a continuous water-repellant film layer located on said first platen surface and said outer edge;

polishing said substrate of said semiconductor wafer with said pad; and interconnecting said transistors to form an integrated circuit.

2. The method as recited in claim 1 wherein said water-repellant film provides said base pad with a water absorbency factor of less than about five percent.

3. The method as recited in claim 1 wherein said polishing pad further comprises a pressure sensitive adhesive located on said water-repellant film.

4. The method as recited in claim 1 further comprising manufacturing a semiconductor device selected from the group consisting of:

a CMOS device, a BiCMOS device, and a Bipolar device.

5. The method as recited in claim 1 wherein said water-repellant film is located on said outer edge, said first platen surface and said second opposing surface.

6. The method as recited in claim 1 further including a main pad located over said second opposing surface.

7. The method as recited in claim 6 wherein said water-repellant film is further located over an outer edge of said main pad.

8. The method as recited in claim 1 wherein said water-repellant film includes polyurethane and a fluorinated polymer.

9. The method as recited in claim 8 wherein said fluorinated polymer is polytetrafluoroethylene.

10. The method as recited in claim 1 wherein said water-repellant film is resistive to chemical reaction with acids or bases.

11. The method as recited in claim 1 wherein said water-repellant film includes a water resistant polymer.

12. The method as recited in claim 11 wherein said water resistant polymer is polystyrene, polypropylene, or polyvinyl chloride.

13. The method as recited in claim 1 wherein said base pad is a felt pad.

* * * * *